United States Patent [19]

Rushing

[11] 4,074,673

[45] Feb. 21, 1978

[54] FLUID VAPOR INJECTOR

[76] Inventor: Jack L. Rushing, 5006 S. Blackwelder, Oklahoma City, Okla. 73119

[21] Appl. No.: 706,750

[22] Filed: July 19, 1976

[51] Int. Cl.[2] ..... F02D 19/00; F02M 17/22

[52] U.S. Cl. ..... 123/198 A; 123/25 L

[58] Field of Search ..... 123/25 R, 25 A, 25 L, 123/198 A; 251/61; 261/18 A

[56] References Cited

U.S. PATENT DOCUMENTS

| | | | |
|---|---|---|---|
| 905,659 | 12/1908 | Courville | 251/61 X |
| 2,219,952 | 10/1940 | Fossberg | 251/61 X |
| 2,756,729 | 7/1956 | Wolcott | 123/25 L |
| 3,537,434 | 3/1970 | Herpin | 123/25 L UX |
| 3,716,040 | 2/1973 | Herpin | 123/198 A |
| 3,790,139 | 2/1974 | Stephenson et al. | 123/25 L X |
| 3,945,565 | 3/1976 | Lynch et al. | 251/61 X |

*Primary Examiner*—Charles J. Myhre
*Assistant Examiner*—Ira S. Lazarus
*Attorney, Agent, or Firm*—Dunlap, Codding & McCarthy

[57] ABSTRACT

An improved fluid vapor injector for injecting a fluid vapor into the intake manifold of an internal combustion engine at a rate generally related to the intake manifold pressure.

2 Claims, 3 Drawing Figures

FLUID VAPOR INJECTOR

BACKGROUND OF THE INVENTION

1. Field of the Invention

This invention relates generally to improvements in fluid vapor injectors and, more particularly, but not by way of limitation, to an improved fluid vapor injector for injecting a fluid vapor into the intake manifold of an internal combustion engine.

2. Description of the Prior Art

The introduction of relatively small quantities of a fluid, such as water, in vapor form into the combustible fuel mixture utilized in an internal combustion engine generally results in slower and, therefore, more efficient burning of the fuel mixture within the combustion chamber of the engine. In general, the fluid vapor may be introduced into the intake portion of the engine via one of three methods. The first method utilizes a relatively low pressure within the intake portion of the engine to draw the fluid vapor into the carburetor or the intake manifold thereof, representative examples being shown in the U.S. Pat. Nos. 1,633,251 issued to Heinz and 1,497,533 issued to Barron. The second method utilizes exhaust manifold back pressure, sometimes in conjunction with the first method, to forcibly inject the fluid vapor into the carburetor or the intake manifold, representative examples being shown in the U.S. Pat. Nos. 2,445,479 issued to Francis and 2,493,808 issued to Garrigus. In the third method, a mechanical or electrical pump is utilized to forcibly inject the fluid vapor into the intake portion of the engine, an example being shown in the U.S. Pat. No. 2,392,565 issued to Anderson et al.

Control of the rate of introduction of the fluid vapor for various engine speeds has been generally accomplished using several methods and/or apparatus. In one method, a pressure-responsive valve is provided to vary the rate of injection in response to changes in intake manifold pressures, representative examples being shown in the U.S. Pat. Nos., 1,441,209 issued to Bollman, 1,613,789 issued to Devary and 1,623,053 issued to Howard et al. A more limited method utilizes pre-set or manually adjustable needle valves to vary the rate of injection of the fluid vapor into the intake portion of the engine, representative examples being shown in the U.S. Pat. Nos. 3,865,907 issued to Rock and 2,556,985 issued to Sparrow et al.

Related methods and apparatus are shown in the following U.S. Pat. Nos.: 1,918,898 issued to Covyeow; 2,300,774 issued to Cartmell; 2,551,836 issued to Gendreau; 2,556,986, issued to Sparrow et al; 2,591,272 issued to Littlejohn et al; 2,756,729 issued to Wolcott; 3,767,172 issued to Mills; 3,856,901 issued to Neumann et al; and 3,875,922 issued to Kirmss.

SUMMARY OF THE INVENTION

An object of this invention is to provide an improved fluid vapor injector for injection of a fluid vapor into the intake manifold of an internal combustion engine.

Another object of the invention is to provide a fluid vapor injector which facilitates more efficient combustion of the fuel mixture within the combustion chamber of an internal combustion engine thereby substantially reducing carbon deposits, providing improved fuel economy and substantially lowering the rate of production of pollutants.

Still another object of the invention is to provide a fluid vapor injector which automatically controls the vapor injection rate in response to varying intake manifold pressure.

One other object of the invention is to provide a fluid vapor injector which is economical to manufacture, easily adaptable to conventional internal combustion engines and is easily and economically maintained.

Other objects and advantages of the invention will be evident from the following detailed description when read in conjunction with the accompanying drawings which illustrate the preferred embodiment of the present invention.

DESCRIPTION OF THE PREFERRED EMBODIMENT

Figure 1:
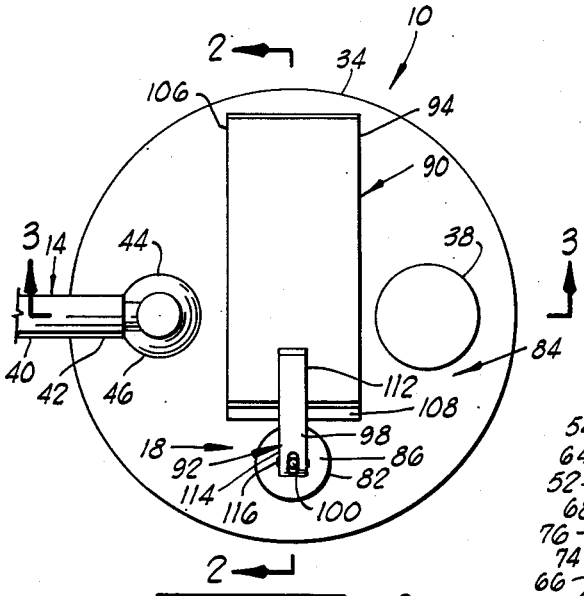
FIG.1 is a top plan view of the fluid vapor injector constructed in accordance with the preferred embodiment of the present invention.
Figure 2:
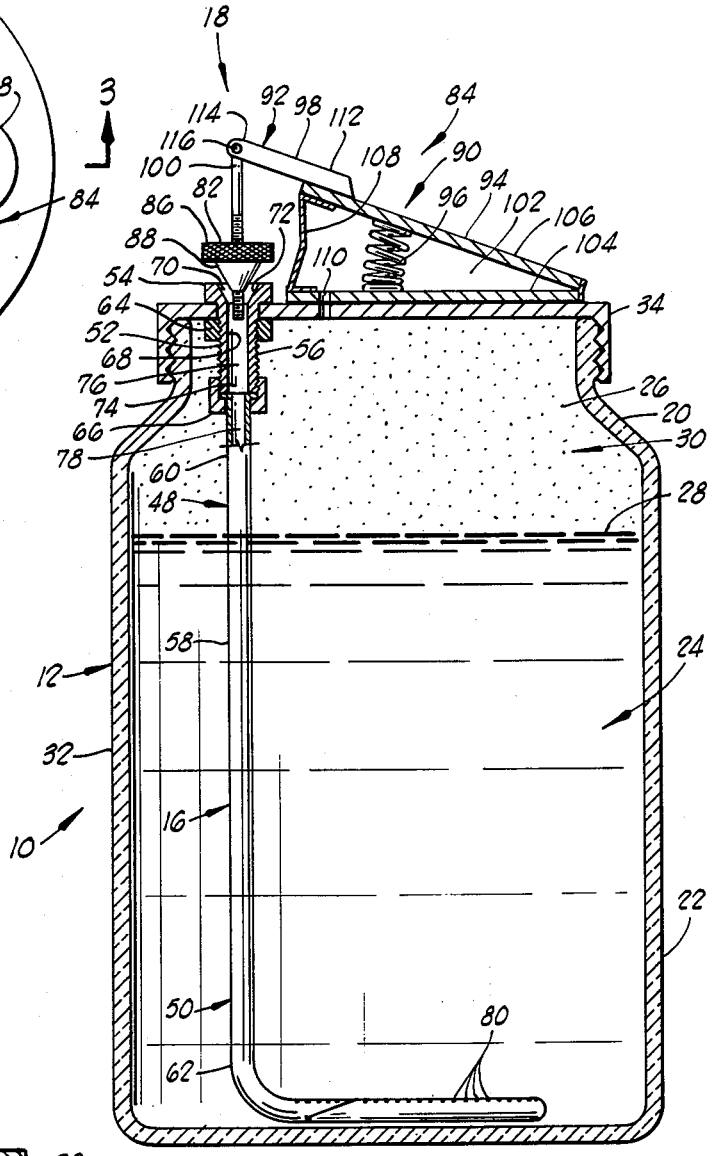
FIG. 2 is a cross-sectional view of the fluid vapor injector shown in FIG. 1 taken along the line 2—2.

Referring to the drawings in general and to FIGS. 1 and 2 in particular, shown therein and designated by the general reference numeral 10 is a fluid vapor injector constructed in accordance with the present invention. The injector 10 is constructed to inject a fluid vapor into the intake manifold (not shown) of an internal combustion engine (not shown) and is generally comprised of a reservoir 12, a fluid vapor conduit 14, an aerator 16 and a valve assembly 18.

Figure 3:
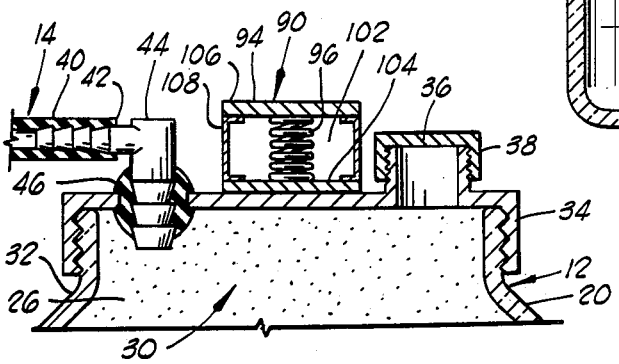
FIG. 3 is a partial cross-section view of the fluid vapor injector shown in FIG. 1 taken along the line 3—3.

The reservoir 12, having an upper end 20 and an opposite lower end 22, has a quantity of fluid 24 retained therein with a vapor chamber 26 being defined between the upper level 28 of the fluid 24 and the upper end 20 of the reservoir 12, the vapor chamber 26 retaining a quantity of the injectable fluid vapor 30. In the preferred embodiment, the reservoir 12 is comprised of a substantially transparent container 32 made of glass or plastic having a lower end forming the lower end 22 of the reservoir 12 and an open upper end. A cover 34 is removably and sealingly connected to the open upper end of the container 32, the cover 34 forming the upper end 20 of the reservoir 12. As can be seen best in FIG. 3, a fill port 36, having a removeably connectable filler cap 38, is provided through a portion of the cover 34 to facilitate filling of the reservoir 12 with the fluid 24.

The fluid vapor conduit 14 has one portion connected to the vapor chamber 26 and another portion connectable to the intake manifold, the fluid vapor conduit 14 providing fluid communication between the vapor chamber 26 and the intake manifold. In the preferred embodiment, the fluid vapor conduit 14 is comprised of a convenient length of flexible tubing 40 having an inlet end 42 sealingly connected through the upper end 20 of the reservoir 12 via a conventional T-connector 44 and a grommet 46, and an outlet end (not shown) sealingly connected to the intake manifold.

The aerator 16, having an upper end 48 extending through the upper end 20 of the reservoir 12, the aerator 16 being sealingly connected to the cover 34. The aerator 16 includes a foraminous lower end 50 portion disposed in the fluid 24 near the lower end 22 of the reservoir 12, and the aerator 16 provides fluid communication between the outside and the inside of the reservoir 12, air being passable into and through the aerator 16 and through the foraminous lower end 50 portion thereof. In the preferred embodiment, the aerator 16 is generally comprised of a substantially cylindrical tubular fitting 52 having a flanged upper end 54 and a threaded lower end 56, and a tubular air conduit 58 having a flanged upper end 60 and a foraminous lower end 62. The upper end 54 of the fitting 52 is sealingly connected through the cover 34 via a conventional nut 64, and the upper end 60 of the air conduit 58 is sealingly connected to the lower end 56 of the fitting 52 via a conventional coupling nut 66, the air conduit 58 extending therefrom to near the lower end 22 of the reservoir 12. The fitting 52 has a cylindrical bore 68 extending axially therethrough, the bore 68 having a counterbored upper end 70 forming a valve seat 72 and an axially opposite lower end 74 defining an air inlet chamber 76. The air conduit 58 has a passage 78 extending therethrough, the passage 78 providing fluid communication between the air inlet chamber 76 and the fluid 24 via a plurality of ports 80.

The valve assembly 18 is constructed to sense the intake manifold pressure and vary the rate of air flow through the upper end 20 of the aerator 16 in response to sensing changes in the intake manifold pressure, with the rate of air flow being decreased in response to a decrease in the sensed pressure and increased in response to an increase in the sensed pressure. The valve assembly 18 is generally comprised of a valve 82 and a valve actuator 84. The valve 82, which is disposed adjacent to the valve seat 72, has a knurled upper end 86 and an axially opposite tapered lower end 88, the lower end 88 corresponding in shape to the valve seat 72 for seatingly engaging the valve seat 72 in one position. The valve 82 substantially prevents the flow of air through the aerator 16 in one position of the valve 82 with the valve 82 seatingly engaging the valve seat 72 and the position of the valve 82 with respect to the valve seat 72 determines the rate of flow of air through the aerator 16 and through the foraminous lower end 50 portion thereof.

The valve actuator 84 is constructed to sense the pressure in the intake manifold and either move the valve 82 toward engagement with the valve seat 72 in response to sensing a decrease in the sensed pressure, thereby decreasing the rate of flow of air through the aerator 16, and to move the valve 82 away from engagement with the valve seat 72 in response to sensing an increase in the sensed pressure, thereby increasing the rate of flow of air through the aerator 16. The valve actuator 84 has a sensor portion 90, generally connectable to the intake manifold and a valve actuating portion 92 connected to the valve 82. More particularly, the sensor portion 90 is in communication with the vapor chamber 26 and, since the pressure in the vapor chamber 26 generally corresponds to the pressure of the intake manifold, the sensor portion 90 is in communication with the intake manifold via the vapor chamber 26 and the fluid vapor conduit 14. The sensor portion 90 is generally comprised of a bellows 94 and a biasing spring 96 while the valve actuating portion 92 is generally comprised of an actuator rod 98 and a threaded valve stem 100.

The bellows 94 is connected to the upper end 20 of the reservoir 12 adjacent to the valve seat 72 with the interior 102 thereof being connected or in communication with the vapor chamber 26, the bellows 94 generally having an open position and a closed position. In the preferred embodiment, the bellows 94 is constructed of a rigid base member 104 bonded to the cover 34, a rigid hinged member 106 hingedly connected to the base member 104 and a resilient diaphragm 108 sealingly connecting the base member 104 and the hinged member 106, the base member 104, the hinged member 106 and the diaphragm 108 substantially enclosing the interior 102. The bellows 94 has the interior 102 thereof connected to, and in fluid communication with, the vapor chamber 26 via a control port 110 extending through the base member 104 and the cover 34.

The biasing spring 96 is connected to the bellows 94 to resiliently urge the bellows 94 toward the open position as shown best in FIG. 2. The spring 96 is preferably disposed within the interior 102 of the bellows 94 generally between the base member 104 and the hinged member 106, the spring 96 being connected to the base member 104 and the hinged member 106. The spring 96 biases the hinged member 106 in one direction generally away from the base member 104, thereby biasing the valve actuator 84 generally toward the opened position.

The actuator rod 98, which has substantially opposite first and second ends 112 and 114, respectively, is connected to the bellows 94 and extends over the valve seat 72, the first end 112 thereof being specifically connected to the hinged member 106 of the bellows 94. The valve stem 100 is pivotally connected to the second end 114 of the actuator rod 98 via a pivot pin 116 so as to depend generally downwardly toward the valve seat 72. In the preferred embodiment, the valve 82 is threaded onto the valve stem 100 so as to be vertically adjustable relative to the valve seat 72 independently of the position of the bellows 94. Thus, the position of the valve 82 is adjustable relative to the valve seat 72 via threadedly positioning the valve 82 on the valve stem 100.

OPERATION

Before the engine is started, the pressure in the intake manifold will be substantially equal to the ambient air pressure surrounding the injector 10 as is well-known to those skilled in the art. In addition, the pressure in the vapor chamber 26 and in the interior 102 of the bellows 94 will also be equal to the ambient air pressure since the fluid vapor conduit 14 provides fluid communication between the intake manifold and the vapor chamber 26 while the control port 110 provides fluid communication between the vapor chamber 26 and the interior 102 of the bellows 94. Thus the bellows 94 will be urged toward the open position via the spring 96 so that the valve 82 will be maintained out of engagement with the valve seat 72 by the actuator rod 98 and the valve stem 100.

The valve 82 should initially be adjusted to the upper limit thereof on the valve stem 100 so that the aerator 16 may provide maximum fluid communication between the inside and the outside of the reservoir 12. Of course, the rate of air flow through the upper end 48 of the aerator 16 will be substantially zero (0) because of the pressure equalization, and any fluid vapor 30 present in the vapor chamber 26 will be due to normal evaporation of the fluid 24. It will be assumed hereinafter that an adequate quantity of the fluid 24 is retained within the reservoir 12 to enable production of the fluid vapor 30.

When the engine is started, the intake manifold pressure is decreased in relation to the ambient air pressure and induces a pressure differential in the vapor chamber 26 via the fluid vapor conduit 14. The decreased pressure will induce a corresponding pressure differential in the interior 102 of the bellows 94, via the control port 110, so that the bellows 94 will be urged toward the closed position via the pressure differential overpowering the biasing spring 96. The movement of the bellows 94 will be transmitted to the valve 82 via the actuator rod 98 and the valve stem 100 so that the valve 82 will be moved toward engagement with the valve seat 72. It is clear, therefore, that the valve actuator 84 effectively senses the change in the intake manifold pressure and moves the valve 82 toward engagement with the valve seat 72 in response to sensing the decrease in the sensed pressure.

The pressure drop in the vapor chamber 26 will simultaneously induce an air flow through the upper end 48 of the aerator 16 with the air flow producing a plurality of streams of bubbles through the fluid 24 via the ports 80 in the lower end 62 of the air conduit 58. The bursting of the bubbles at the upper level 28 of the fluid 24 produces fluid vapor 30 within the vapor chamber 26 for injection into the intake manifold via the fluid vapor conduit 14.

As will be clear to those skilled in the art, the rate of injection of the fluid vapor 30 will be effectively determined by the position of the valve 82 relative to the valve seat 72 for any particular position of the bellows 94. It has been determined that the rate of injection should be minimized when the engine is idling and maximized when the engine is running at top speed. Minimum vapor injection is substantially effected while the engine is idling via "unscrewing" the valve 82 downwardly upon the valve stem 100 into relatively tight engagement with the valve seat 72.

As the engine speed is increased, the intake manifold pressure also increases in relation to the ambient air pressure thereby decreasing the pressure differential induced in the vapor chamber 26 and the interior 102 of the bellows 94. The bellows 94 will, therefore, be urged toward the open position via the pressure differential overpowering the spring 96 to a relatively lesser degree. The movement of the bellows 94 will be transmitted to the valve 82 via the actuator rod 98 and the valve stem 100 so that the valve 82 will be moved away from engagement with the valve seat 72. Thus, it is clear that the valve actuator 84 effectively senses the change in the intake manifold pressure and moves the valve 82 away from engagement with the valve seat 72 in response to sensing an increase in the sensed pressure.

Since the valve 82 is substantially disengaged from the valve seat 72, an air flow will be induced through the aerator 16 producing a plurality of relatively denser streams of bubbles through the fluid 24 via the ports 80, the bubbles producing fluid vapor 30 for injection into the intake manifold as described above. As will be clear to those skilled in the art, the air flow rate and the vapor injection rate will continue to increase as the engine speed increases until reaching a level when the engine is running at top speed.

When the engine speed is decreased, the intake manifold pressure is also decreased in relation to the ambient air pressure to increase the pressure differential induced in the vapor chamber 26 and the interior 102 of the bellows 94. The bellows 94 will, therefore, be urged toward the closed position via the pressure differential overpowering the spring 96 to a relatively greater degree. The movement of the bellows 94 will be transmitted to the valve 82 via the actuator rod 98 and the valve stem 100 so that the valve 82 will be moved toward engagement with the valve seat 72. Thus, the valve actuator 84, effectively sensing the change in the intake manifold pressure, moves the valve 82 toward engagement with the valve seat 72 in response to sensing an increase in the sensed pressure.

Since the valve 82 is moved toward engagement with the valve seat 72, the air flow rate through the aerator 16 will be correspondingly reduced producing a plurality of relatively less dense streams of bubbles via the port 80, the bubbles thereby producing the injectable fluid vapor 30. Furthermore, the air flow rate and the vapor injection rate near the minimum levels thereof as the engine speed nears idling speed.

The quantity of fluid 24 retained within the reservoir 12 will of course gradually become depleted with use of the injector 10 and may be replenished via refilling the reservoir 12 via the filler port 36.

Changes may be made in the construction of the parts or elements, or in the methods as described herein, without departing from the spirit and the scope of the invention as defined in the following claims.

What is claimed is:

1. A fluid vapor injector for injecting a fluid vapor into the intake manifold of an internal combustion engine, the injector comprising:

a reservoir for retaining a quantity of the fluid, the reservoir having an upper end, a lower end, and a vapor chamber defined therein generally between the upper level of the fluid and the upper end of the reservoir;

a fluid vapor conduit having one portion connected to the vapor chamber and another portion connected to the intake manifold, the fluid vapor conduit providing fluid communication between the vapor chamber and the intake manifold;

an aerator having an upper end extending through the upper end of the reservoir and a foraminous portion disposed in the fluid, the aerator providing fluid communication between the upper end thereof and the foraminous portion thereof; and a valve assembly comprising:

a valve seat formed in the upper end of the aerator;

a bellows disposed generally above, and connected to, the upper end of the reservoir, the bellows comprising:

a base member connected to the upper end of the reservoir;

a hinged member pivotally connected to the base member, the hinged member being movable in one direction generally away from the base member and in one other direction generally toward the base member; and a resilient diaphragm sealingly connected between the base member and the hinged member, the resilient diaphragm cooperating with the base member and the hinged member to define the interior of the bellows;

A biasing spring disposed in the interior of the bellows between the base member and the hinged member, the biasing spring biasing the hinged member in the one direction generally away from the base member;

means providing fluid communication between the interior of the bellows and the vapor chamber;

an actuator rod having a first end connected to the hinged member and a second end extending over the valve seat, the actuator rod moving with the hinged member; and a valve stem pivotally connected to the second end of the actuator rod and depending generally downwardly toward the valve seat; and a valve threaded onto the valve stem adjacent to and vertically above the valve seat, the valve moving with the actuator rod toward seating engagement with the valve seat as the hinged member moves toward the base member and away from seating engagement with the valve seat as the hinged member moves away from the base member, the position of the valve with respect to the valve seat determining the rate of flow of air through the aerator.

2. The apparatus of claim 1 wherein the reservoir is defined further to include:

a container having a lower end forming the lower end of the reservoir and an open upper end; and a cover removably connected to the open upper end of the container, the cover forming the upper end of the reservoir.

* * * * *